United States Patent [19]

Portalier

[11] 4,143,674

[45] Mar. 13, 1979

[54] VALVE FOR CONTINUOUSLY AND AUTOMATICALLY SUPPLYING FURNACES WITH MOLTEN METAL

[75] Inventor: Robert Portalier, Ville D'Avray, France

[73] Assignee: Societe de Vente de l'Aluminium Pechiney, Paris, France

[21] Appl. No.: 786,882

[22] Filed: Apr. 12, 1977

[30] Foreign Application Priority Data

Apr. 28, 1976 [FR] France ..... 76 13456

[51] Int. Cl.[2] ..... F04F 10/00; B22D 47/02; B22D 35/00

[52] U.S. Cl. ..... 137/151; 137/143; 137/153; 164/306; 251/296

[58] Field of Search ..... 137/142, 143, 145, 151, 137/153; 164/306, 337; 251/304, 296

[56] References Cited

FOREIGN PATENT DOCUMENTS 2293275 7/1976 France ..... 137/151

1352721 8/1974 United Kingdom ..... 137/625.46

*Primary Examiner*—Gerald A. Michalsky

*Attorney, Agent, or Firm*—Dennison, Dennison, Meserole & Pollack

[57] ABSTRACT

A valve for use in an apparatus for supplying molten metal by means of a siphon to a furnace. A valve formed by a tube provided with two flanges is placed at the upper part of the siphon, this tube extending by a certain length below the level of the flanges, so as to form an annular space with each of the branches of the siphon in which the gas is trapped during decanting, which prevents the gaskets from being in contact with the molten metal.

3 Claims, 8 Drawing Figures

VALVE FOR CONTINUOUSLY AND AUTOMATICALLY SUPPLYING FURNACES WITH MOLTEN METAL

French Pat. No. 2,293,275 describes an apparatus for continuously and automatically supplying furnaces which provide machines for casting metals and alloys under low pressure, and, in particular, aluminum alloys with molten metal.

This prior art device is shown schematically in FIGS. 1 and 2, and is described for background herein. It is designed to supply a casting machine comprising a mold 1 and a low pressure residence furnace 2 with molten metal. The mold 1 comprises a fixed section 3 and a movable section 4 which is movable in a vertical direction, the mold being closed when the section 4 is in the low position. The fixed section 3 includes a supply nozzle 5 connected to a supply tube 6 which extends into the molten metal 7. The furnace 2 comprises a crucible 8 which is housed in a sealed chamber 9 in which a gas pressure may be established so as to discharge the molten metal 7 contained in the crucible 8 through the tube 6 and into the mold 1. The chamber 9 is connected via a tube 10 to a tap 11 which communicates with two other pipes, one 12 of which is connected to a compressed gas supply, the other 13 being open to the ambient air.

The supply device comprises a valve 14 consisting of two parts: a body 15 on whose lower section two plunger tubes 16 and 17 are fixed, the end of the tube 16 depends into the molten metal 7 in the residence furnace 2, while the end of the tube 17 depends into the molten metal 18 in a furnace tank 19 which is preferably equipped with a decanter 20; and a movable cover 21 which is applied to the body 15, the tightness between the cover and the body being ensured by a gasket 22 which resists heat and which forms an integral part of either the cover 21 or the body 15, or is divided between the two parts; it is preferably placed on the body so that it may be regulated and replaced simply without slowing down the manufacturing cycle, by rotating around its axis, the cover 21 may occupy two positions which are 90° apart, the first placing the two tubes 16 and 17 in communication according to FIG. 1, the other allowing this communication to be suppressed as in FIG. 2.

The assembly formed by the valve and the tubes is maintained at a suitable temperature of from 600° to 700° C. for aluminum and its alloys, by means of gas banks or any other known device (not shown).

The movable cover 21 of the valve 14 passes from one position to another by being raised, rotated by 90° and lowered again. This movement may be ensured by mechanical, hydraulic, pneumatic or electrical means. In the Example shown, the cover 21 forms an integral part of the axle 23 of a jack 24 which ensures raising, this axis also being connected by a lever 25 to a second jack or motor 26 which assures rotation.

The cover of the valve communicates via a pipe 27 with a three-way tap 28 which allows the cover to be connected either to means allowing an instantaneous drop in pressure to be created, for example a vacuum pump 29 provided with an intermediary flask 30, or to an inert gas supply under pressure, for example a plug reservoir 31 connected at 32 to a bottle of neutral gas, for example compressed nitrogen, not shown, by means of a pressure reduction gage 33. A pipe 34 may be mounted between the exhaust of the vacuum pump 29 and the plug tank 31 in order to recover the neutral gas. A gage 35 fixed on the cover 21 of the valve allows the level of the molten metal to be delimited in the chamber 36 by the valve.

Without having to repeat the details of the stage-by-stage operation of the low pressure casting machine and its supply system, it is clear that in the position shown in FIG. 1 it is sufficient to maneuver the tap 28 so as to place the chamber 36 in communication with the vacuum chamber 30 for the molten metal to rise in each branch, and prime the siphon allowing the crucible 8 to be filled with the metal contained in the furance tank 19. Filling stops when the levels are equalized in furnaces 8 and 19. At this moment, the tap 28 maneuver places the chamber 36 in communication with the neutral gas reserve 31 and causes the molten metal to redescend into each of the branches of the siphon.

On the other hand, when the article is being cast, the communication between the two branches of the siphon has been interrupted by the 90° rotation of the turning valve, as shown in FIG. 2.

The super-pressure which is exerted in the sealed chamber 9 then causes the metal to rise in the tube 6 and the mold 1 as well as in the tube 16, but to a lesser height, the compression of the gas contained in the chamber 36 resisting this rise of the metal.

The present invention relates to an improvement in this rotating valve 14. The upper 21 and lower 15 halves of this valve are separated by a gasket 22 which must be air-tight but which is in contact with the metal during the siphoning operation. Serious problems arise concerning the strength of this gasket upon contact with the molten metals, and, in particular, aluminum alloys.

The applicant has invented a novel valve system which also functions in an identical manner to the valve described in French Pat. No. 2,293,275, but which solves the problems of the strength of the gasket since the molten metal no longer touches the gaskets in this valve.

In the drawings, FIGS. 1 and 2 are schematic cross-sections showing the prior art system with the valve in communication between the two furnaces and out of communication respectively;

Figure 1:
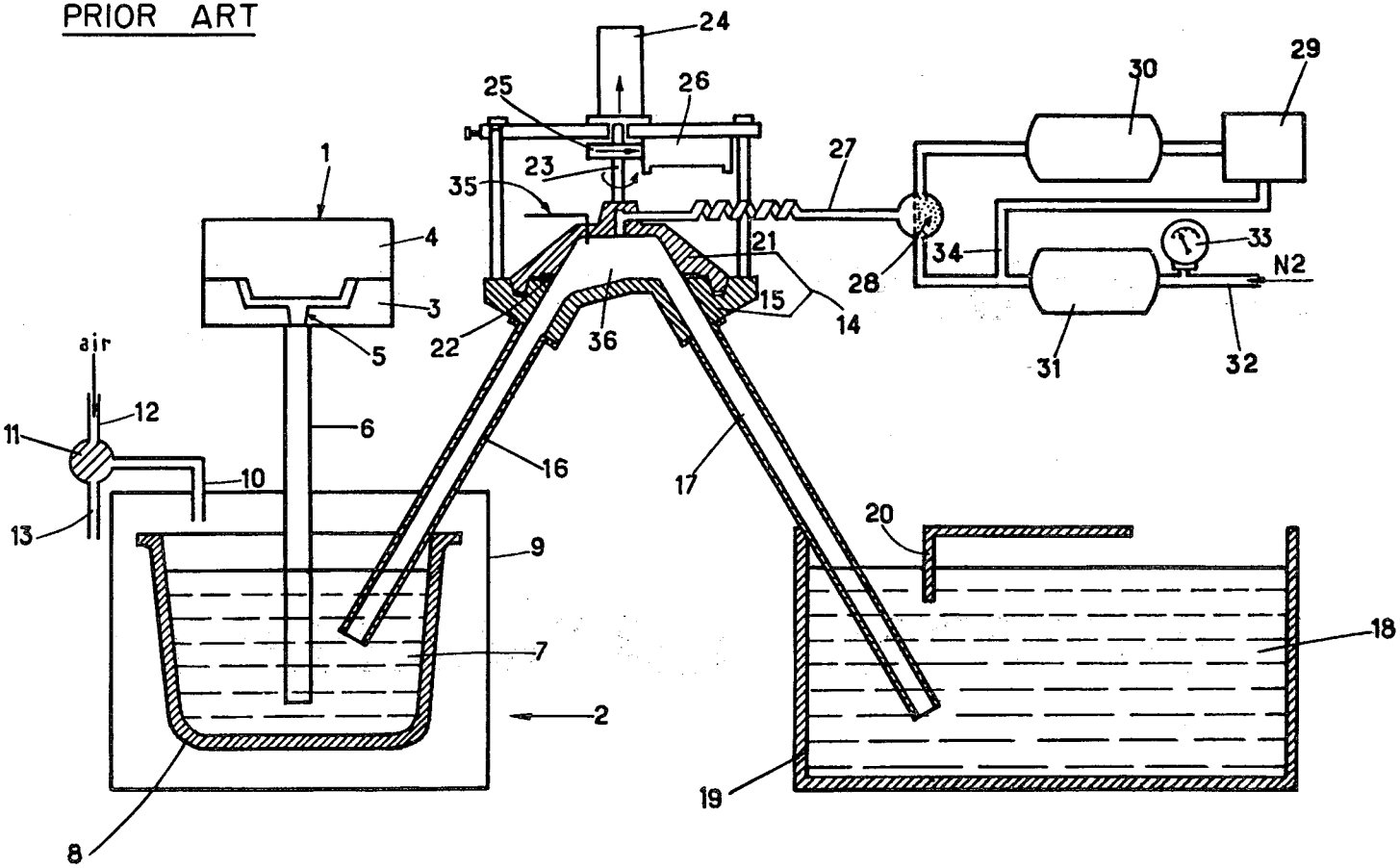
FIG. 1 PRIOR ART
Figure 2:
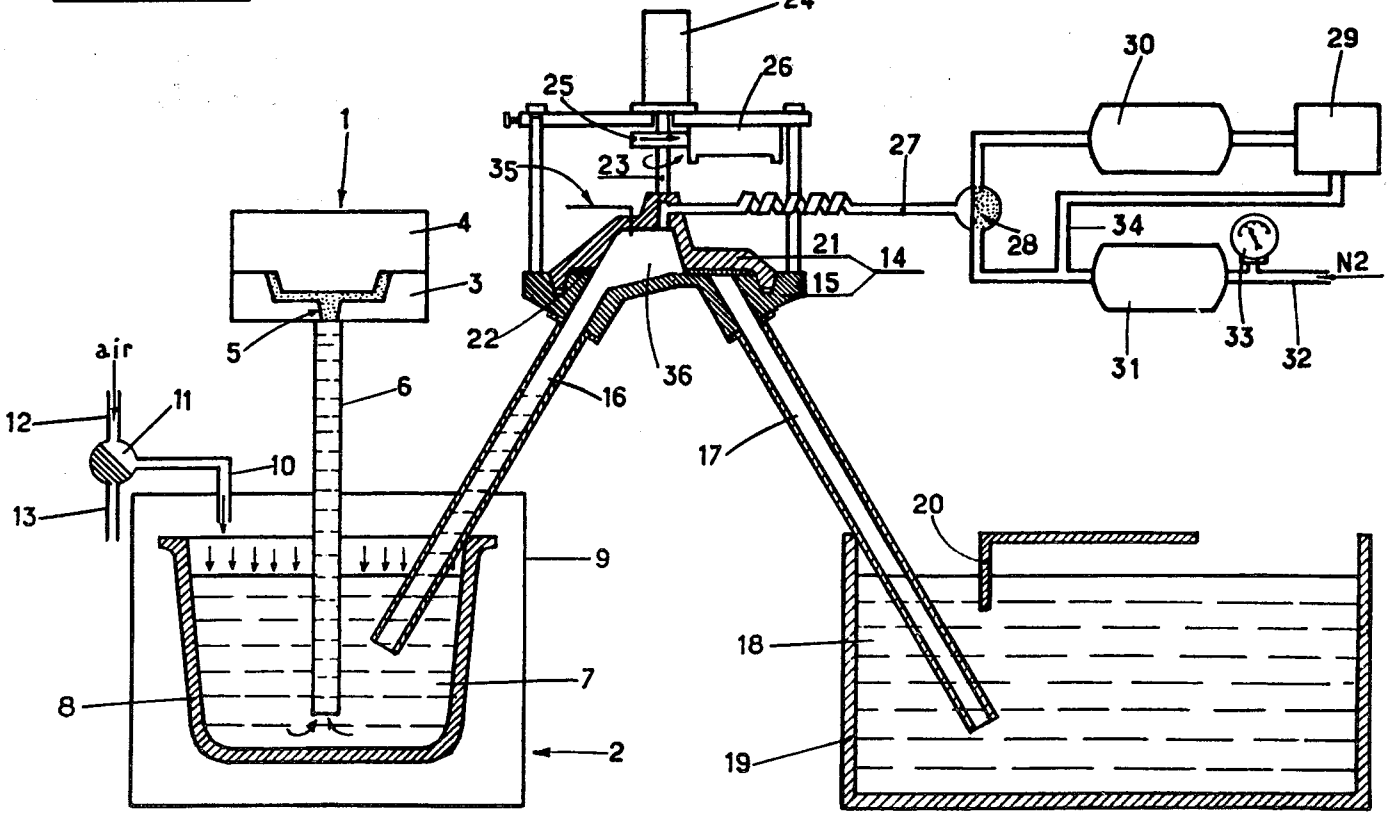
FIG. 2 PRIOR ART
Figure 3:
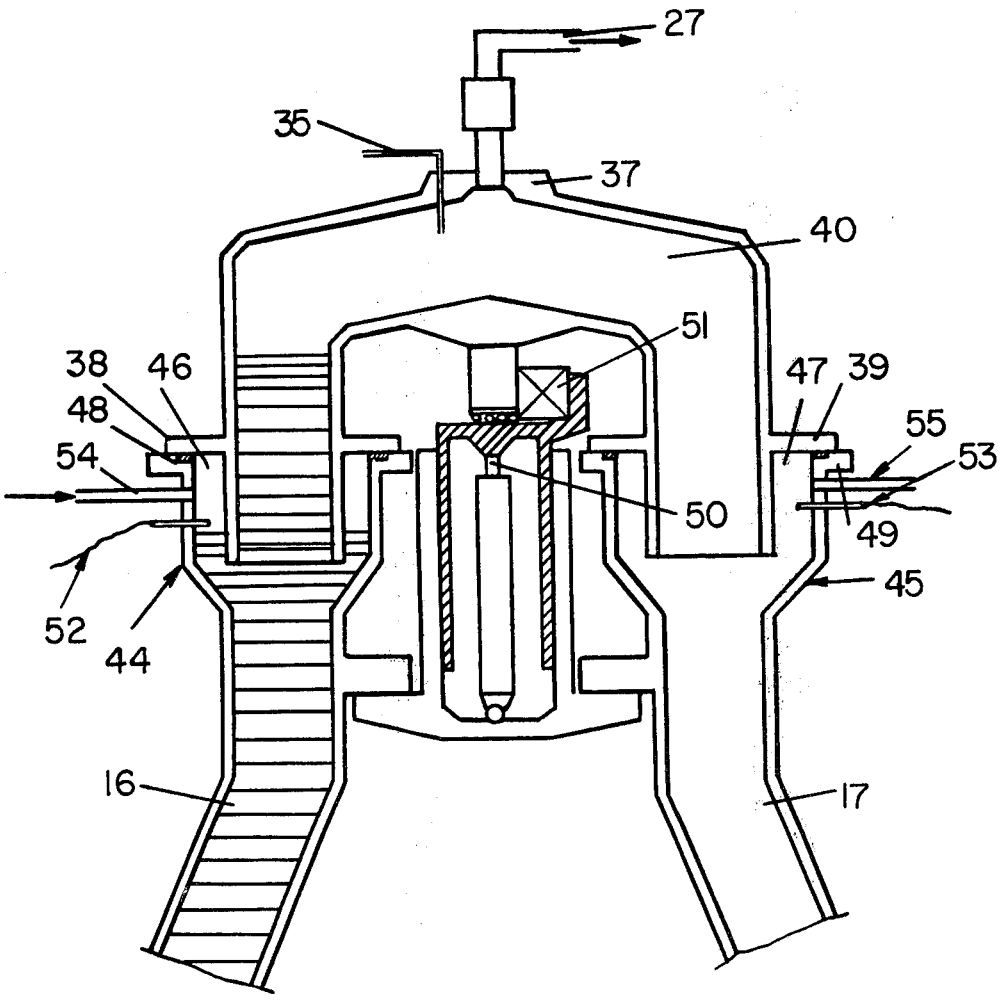
FIG. 3 is a vertical section through the valve of the present invention.

The new valve is shown in detail in FIG. 3, in section, in the siphoning position. The numbers 16 and 17 correspond to the two branches of the siphon, as in FIGS. 1 and 2.

The valve is formed by a body 37 in the shape of an inverted U, comprising four flanges. Two of the flanges 38 and 39 are connected by a tube 40 which allows the two pipes 16 and 17 to communicate; the other two flanges or cover plates 41 and 42, situated in a same horizontal plane at 90° to the flanges 38 and 39, are full. They are connected to the tube 40 by ribs 43. The tube 40 extends vertically below the plane of each of the flanges 38 and 39 through a vertical cylindrical tube which delimits two annular spaces 46 and 47 with the sockets 44 and 45 of the branches of the siphon. The flanges 38, 39, 41 and 42 are placed on the flanges 48 and 49 which are situated on the upper section of the branches of the siphon, with the aid of gaskets made for example of asbestos.

Just like the valve described in the French patent supra, the upper section of the tube 40 is either connected via a pipe 27 to a vacuum supply or to an inert gas supply. The rising and falling of the tube are assured by a mechanism such as a jack 50, and rotation in the raised position of the tube is assured by the mechanism which is shown schematically at 51.

Figure 4:
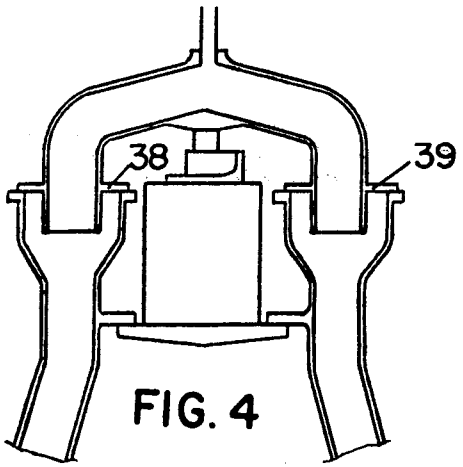
FIG. 4 is an elevation of the valve in a successive position of operation.
Figure 5:
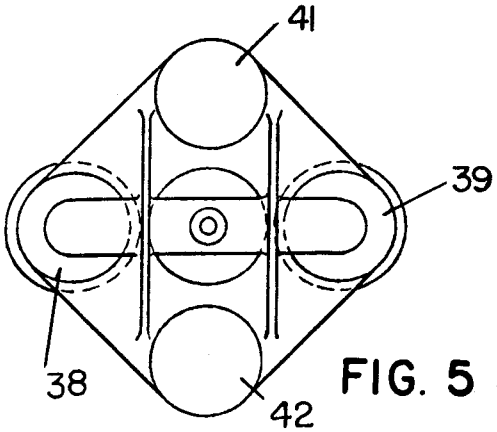
FIG. 5 is a plan view of the valve of FIG. 4 as seen from above.

The valve operates in the following manner. In order to prime the siphon (FIGS. 4 and 5) the flanges 38 and 39 rest on the ends of the branches of the siphon 16 and 17. The siphon is now "open." A reduced pressure is created in the siphon assembly by means of the pipe 27. The molten metal rises in the two pipes 16 and 17. When the level of the metal reaches the lower end of the tubes which extend the body of the valve, an air cushion is trapped in the annular spaces 46 and 47. This air cushion slightly compressed by the rise of the metal in the siphon, prevents the molten metal from coming into contact with the gasket. Two electrodes 52 and 53, placed in the annular spaces, detect the rise of the molten metal in the event of leakages to the gaskets and, in this case, cause an air or neutral gas inlet tap to open by means of pipes 54 and 55, which causes the level of the molten metal to redescend in the annular space. Once the level falls below the electrode, the tap of pipes 54 and 55 closes again, assuring that the level in the annular space is automatically regulated in the event of leakage to the gasket. A second electrode may also be used in each annular space for regulating the metal in the annular space between a high level and a low level.

When the molten metal reaches the top of the valve, the siphon is primed and the molten metal is decanted in the same conditions as those described in the French patent until the molten metal reaches the same levels in the furances. An electrode, placed at the upper section of the valve, detects the arrival of the molten metal and causes the tap connecting the valve to the vacuum source to close. After decanting, the pipe 27 is placed in communication with atmospheric pressure again, unpriming the siphon and causing the metal to redescend into each of the branches.

Figure 6:
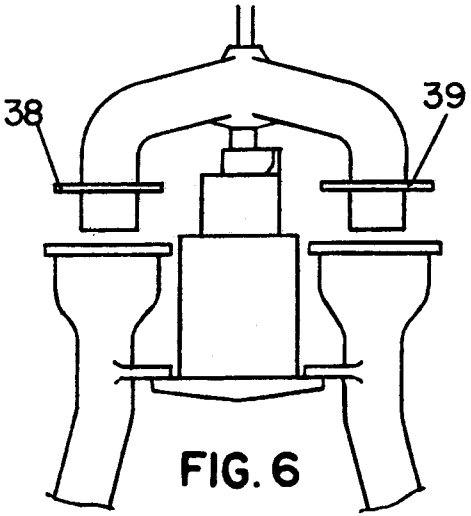
FIG. 6 is an elevation of the valve at a further point in its operation.

In order to cast the article, the communication between two branches of the siphon must be cut so as to prevent the pressure exerted on the metal for supplying the mold from discharging the metal in the siphon and repriming it. The valve is raised with the aid of the jack 50, as shown in FIG. 6, so that the section of the valve tubes which is below the flanges 38 and 39 is freed from the tubes 16 and 17.

Figure 7:
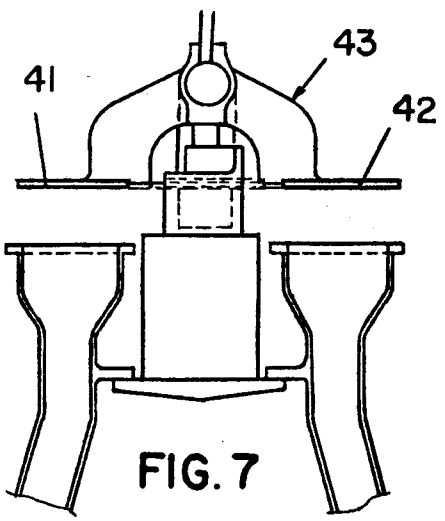
FIG. 7 is an elevation of the valve at the final stage of its operation.
Figure 8:
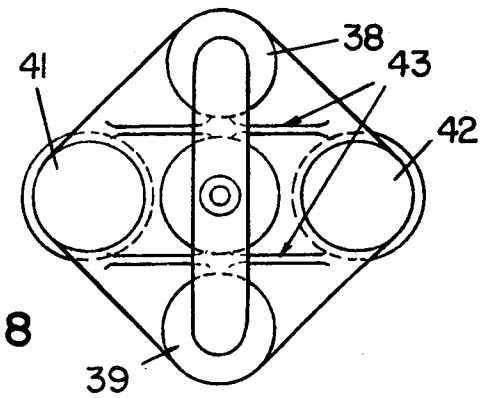
FIG. 8 is a plan view of the valve of FIG. 7 as seen from above.

The body of the valve is then turned by 90° with the aid of the motor mechanism 51 (FIGS. 7 and 8) so that the full flanges 41 and 42 are situated opposite the axis of the ends of the tubes 16 and 17.

By means of the jack 50, the valve is then lowered so as to place the two full flanges on the gaskets of the tubes 16 and 17 in order to isolate them while assuring a perfect seal.

The article may then be cast in the manner described above.

I claim:

1. In a device for supplying molten metal to a furnace in a machine for casting metal under low pressure, said device having a first and a second siphon tube, the improvement comprising a valve for controlling the flow of said molten metal to said siphon tubes and a mating fitting at the inlet of each siphon tube, said fitting including a neck end of wider diameter than said siphon tube and an annular flange at the top edge of said neck end, said valve including an inverted U-shaped tube having a pair of depending legs, each in fluid communication with the other and of a diameter less than said neck end, an annular flange on each of said legs spaced upwardly from the free ends thereof, said flanges on said legs adapted to cooperate with the flanges on said neck ends of the siphon tubes with the free ends of said legs extending into said neck ends, gasket means interposed between said cooperating flanges, a pair of full face cover plates, rib means extending from said U-shaped tube to mount said cover plates coplaner with and disposed at 90° to said annular flange on the depending legs of the tube, means for lifting and lowering said tube, and means for rotating said U-shaped tube when raised, whereby said first and second siphon tubes are interconnected by said depending legs of the U-shaped tube during furnace supply and said siphon tubes being closed by said cover plates during casting.

2. In a device as set forth in claim 1, wherein the annular space between the bottom end of each of said depending legs and the cooperating flanges defining an air trapping space free from molten metal.

3. In a device as set forth in claim 2, and further including electrical sensing means in said annular space to detect the rise of molten metal in the event of leakage, and a gas inlet tap in communication with each annular space, said sensing means when activated by molten metal opening said inlet taps to cause the level of molten metal to descend.

* * * * *